United States Patent [19]

Winker et al.

[11] 4,335,674

[45] Jun. 22, 1982

[54] APPARATUS FOR APPLICATION OF A HOT MELT GLUE ONTO THE BACK SURFACES OF BOOK BLOCKS

[75] Inventors: Gerald Winker, Leipzig; Hans-Peter Thrandorf, Grossdalzig; Christian Blum, Leipzig, all of German Democratic Rep.

[73] Assignee: VEB Kombinat Polygraph "Werner Lamberz" Leipzig, Leipzig, German Democratic Rep.

[21] Appl. No.: 167,318

[22] Filed: Jul. 10, 1980

[30] Foreign Application Priority Data

Aug. 13, 1979 [DD] German Democratic Rep. ... 214943

[51] Int. Cl.[3] ..... B05C 1/02; B42C 9/00

[52] U.S. Cl. ..... 118/110; 118/223; 118/713; 118/DIG. 14

[58] Field of Search ..... 11/1 AD; 118/223, 713, 118/DIG. 14, 251, 110, 101, 255

[56] References Cited

U.S. PATENT DOCUMENTS 1,023,569 4/1912 Juengst ..... 118/110
2,360,918 10/1944 Wade ..... 118/DIG. 9
3,093,396 6/1963 Segreto ..... 11/1 AD X
4,213,420 7/1980 Martino ..... 118/713

FOREIGN PATENT DOCUMENTS 846986 8/1952 Fed. Rep. of Germany .... 11/1 AD
934823 8/1963 United Kingdom ..... 11/1 AD

*Primary Examiner*—John P. McIntosh
*Attorney, Agent, or Firm*—Michael J. Striker

[57] ABSTRACT

An apparatus for applying hot melt glue to back surfaces of book blocks, wherein these back surfaces are distributed in fan-like fashion, by means of glueing rollers, two of which are consecutively arranged conically-shaped rollers which are adjustable in their angular setting, whereby the tearing out resistance of the sheet edges is increased. Each glueing roller is supported in an individual glue pan which may be separately pivoted and adjusted in its height. By adjusting of angular setting of the aforementioned two rollers the vertical position of each glue pan may be corrected. This will ensure a uniform and sufficiently large glue layer over the back surfaces of the blocks throughout the entire process of glueing.

10 Claims, 3 Drawing Figures

APPARATUS FOR APPLICATION OF A HOT MELT GLUE ONTO THE BACK SURFACES OF BOOK BLOCKS

BACKGROUND OF THE INVENTION

The invention relates to an apparatus for the application of hot melt glue onto the back surfaces of blocks, preferably of book blocks during block transport within a block conveyor with block conveying means carrying the blocks in their longitudinal direction with the block back surfaces oriented downward, and with glueing rollers arranged below said means of block transport. By the object of DD Letters Pat. No. 119 555, an apparatus for the glueing of block back surfaces, preferably of book blocks, has become known, wherein one or a plurality of the glueing rollers are arranged obliquely to the block back surfaces when viewing these back surfaces in the direction of transport, and perpendicularly or at an angle to the direction of transport, so that the block back surfaces will be spread out fanlike thereby. Herein, the lateral fanning out of block back surfaces during the glueing sequence is accomplished by one or a plurality of guide rails or guide rollers extending into the zone within which the block back surfaces are being transported. In this apparatus, the glueing rollers may furthermore be designed in the shape of a cone or the frustum of a cone.

The apparatus as above is, however, suitable only for the dispersion glueing of blocks. Since the glueing rollers are arranged at an angle to the glue pans and are also pivotable, the glue pans are of a relatively low height so that the glueing rollers will have only low immersion at least over a part of the arrangement. Furthermore, not every glueing roller is provided with its separate glue pan. Despite the advantageous principle of the solution as per invention of DD Letters Pat. No. 119 555, it is a consequence of the aforenoted criteria that this apparatus is particularly unsuitable for application with hot melt processes. Due to the need for a low design height and due to the functioning of the apparatus not allowing separation of individual glue pans, thermal losses due to inadequate heating of the hot melt glue would be of such magnitude that during the application onto the block back surfaces the glue would not be at a temperature that would result in a tearing resistance of the page edges higher than attainable in the dispersion glueing process. Glueing of the blocks is furthermore also interferred with, since there may be very different glue levels within individual glue pans, and gaging of these levels is not ensured herein. Finally, optional arrangement of one or a plurality of glueing rollers will not in every instance allow attaining the intended effect of this apparatus as attained with an arrangement of glueing rollers described in the embodiment of DD Letters Pat. No. 119 555.

SUMMARY OF THE INVENTION

It is an object of the invention that the satisfactory average durability of blocks, and book blocks in particular mechanically glued during continual conveying as attained by the dispersion glueing process applied to the blocks in the known process is considerably increased.

The invention is based upon the task of creating an apparatus for the mechanical glueing of block back surfaces, preferably book block back surfaces, which, compared to the dispersion glueing process, will result in a considerable increase of tearing-out resistance of the page edges during continual conveying, and also in wetting the sides of the page edges with hot melt glue of the required temperature, thus bringing about a considerable further development of the principles of the advantage of known apparatus for the hand glueing of blocks.

These and other objects of the invention are attained by providing within the apparatus of the foregoing type a minimum of three glueing rollers, and by providing at the access to the apparatus when viewed in the direction of block travel two glueing rollers of conical or conical frustum shape set at an angle towards each other, by providing appurtenant to these rollers a cylindrical glueing roller, and by rotatably supporting the glueing rollers individually, each in one respective glue pan that is pivotable and adjustable vertically and by interconnecting the glue pans in order to allow for equalizing the monitorable level of hot melt glue in the glue pans. A return spinning roller, rotating in the opposite direction, may be arranged appurtenant to the cylindrical glueing roller. It will be appropriate herein to connect the glue pans with heat resistant level-equalizing pipes that are angularly and longitudinally movable, said pipes, preferably made of polytetrafluorethylene, either being led in through heat resistant seals supported in the glue pan housings or attached directly on the glue pan housings.

In order to monitor the level of hot melt glue in the glue pans, one glue pan may be with a sight glass that may form a component of the glue pan housing. Above the cone shaped glueing rollers one, or a plurality of guide rails or guide rollers may be located extending into the transport zone of the block back surfaces, in order to aid in the fanlike spreading of block back surfaces during the glueing process within the longitudinal conveying flow.

The glue pans may be pivotally arranged and vertically adjusted so that the pivotability and vertical adjustability of the glue pans as per invention, allows for optimum design height of the heatable glue pan walls i.e. close to the plane of contact between blocks and glueing rollers. Adequate heating of the hot melt glue is assured thereby. It is particularly the device for vertical adjustment of the glue pans that will allow correcting the height of the glue pan and thus the appurtenant roller, in case of a variation of the angular ratio of the roller surface to the block, caused by pivoting of one of the glue pans with its appurtenant cone shaped glueing rollers, so that application of a uniformly constant glue film onto the block back sides is ensured thereby. It is further possible thereby to set the glueing rollers at optimal depth within the glue pans, so that the thermal loss on glueing of the blocks will be negligibly small. Furthermore, by having one individual glue pan appurtenant to each glueing roller, the hot melt glue will be of uniform temperature at each locus of glueing.

Due to these optimal design and functional criteria attained in glueing with hot melt glue the tearing-out resistance of page edges is considerably increased when compared to the dispersion glue process. Finally, the interconnection of glue pans in conjunction with the sight glass will ensure that the hot melt glue of all glue pans will be at an adequate level during the entire glueing process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
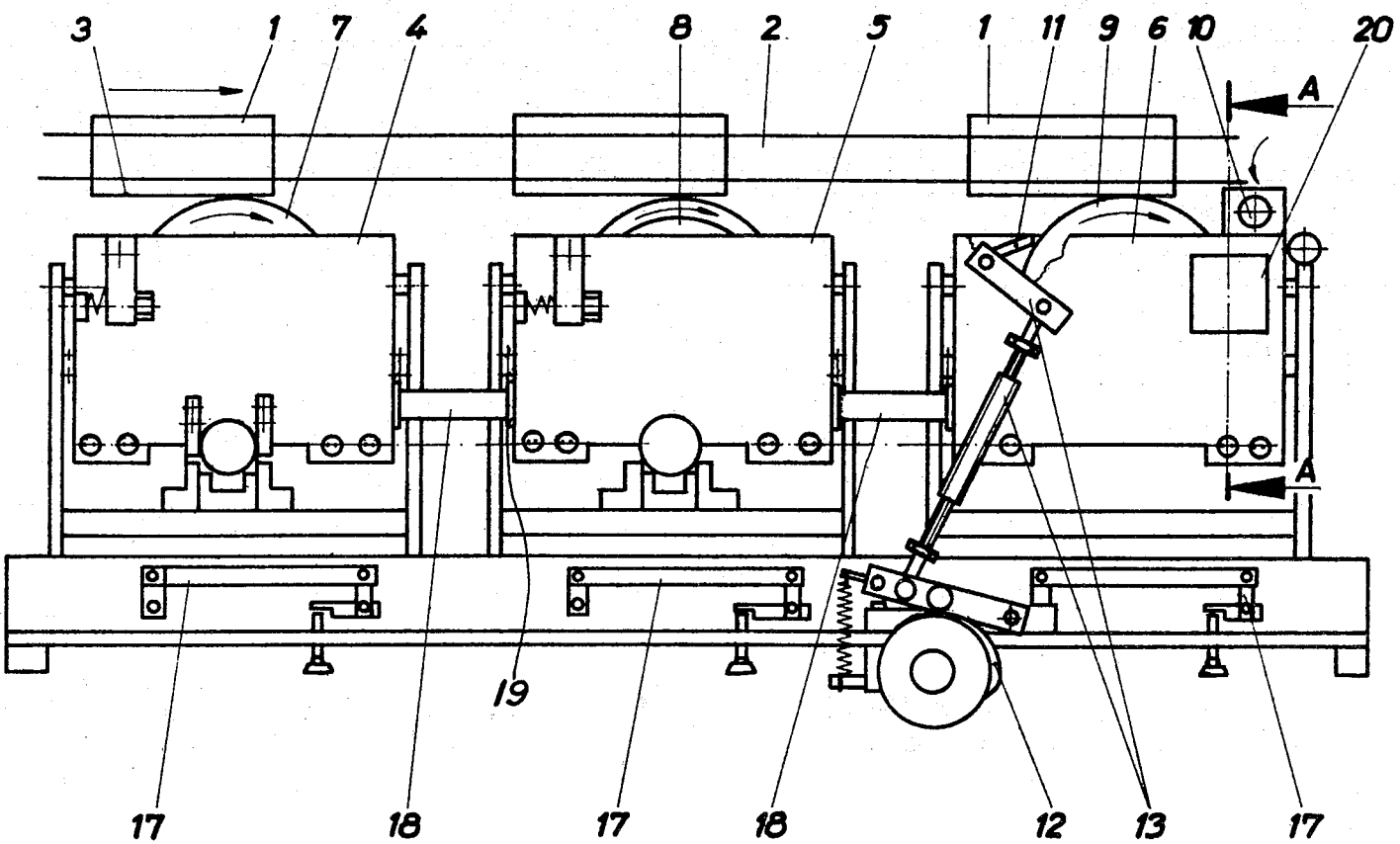
FIG. 1 is a side elevational view of a block conveyor.

As can be seen from FIG. 1, blocks 1 are carried in a block conveyor by block conveying means 2 preferably clamping straps or conveyor pans. The block back surfaces 3 are oriented downward herein and slide over cone-frustum-shaped glueing rollers 7, 8. These so-called fan glueing rollers are immersed into glue pans 4 and 5 and are rotatably supported in said glue pans and set at an angle to each other, with the block back surfaces 3 furthermore sliding over a cylindrical glueing roller 9 immersed into a glue pan 6 as well as over an electrically heated and oppositely driven return spinning roller 10. These rollers are provided in the known manner with adjustable glue blades 11, with the glue blade of glue roller 9 being controlled in its operating phases according to a block length by means of the cam 12 and linkage 13 in order to ensure a uniform glue film over the entire block. Guide rails 14 to aid in fanning the blocks are located above the glueing rollers 7, 8—FIG. 2.

Figure 2:
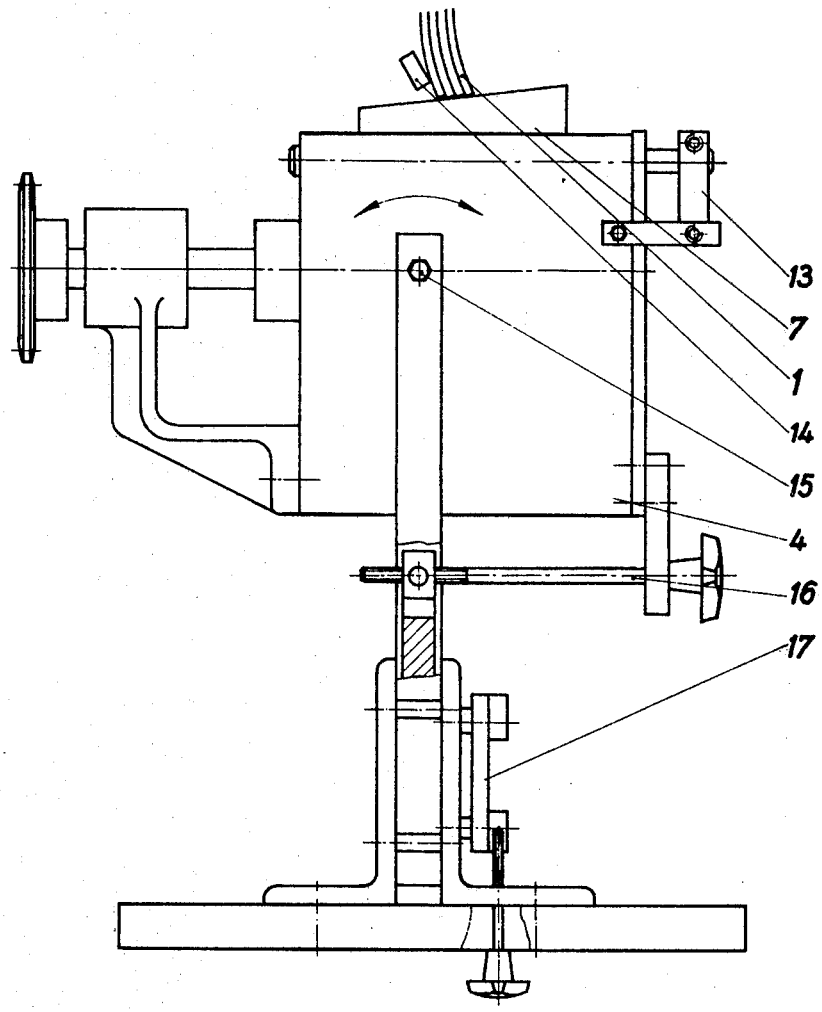
FIG. 2 is a front elevational view of the block conveyor shown in FIG. 1.
Figure 3:
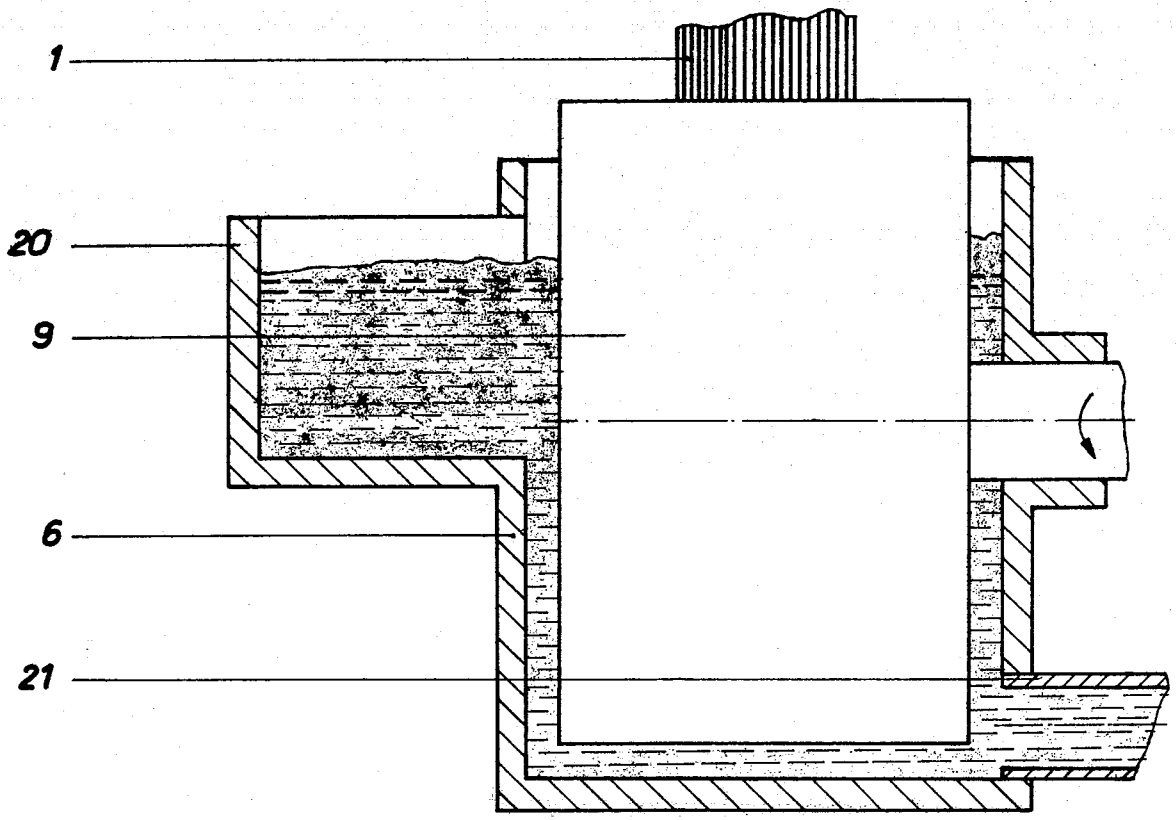
FIG. 3 is a sectional view taken along line A—A of FIG. 1.

Representation of guide rails 14 has been dispensed with in FIG. 2 for the sake of clarity. The glue pans 4 to 6 are pivotably held by brackets 16 as seen in FIG. 2. The glue pans 4, 5 jointly with the glueing rollers 7, 8 of a taper angle between 5° and 10°, may be pivoted for any desired angle in the range from −15° through to 15° by means of a threaded spindle 15. The required vertical correction of glue pans 4, 5 is made by means of a linkage 17. The glue pans 4 to 6 are interconnected by longitudinally and angularly displaceable equalizing pipes 18 led through heat-resistant seals 19 supported in the glue pan housings, so that an identical hot melt glue level is ensured in each of these pans. Uncomplicated checking of the level of glue within high housing walls of glue pans 4 to 6, is ensured by a sight glass 20 forming a component of the housing of glue pan 6 and arranged at the operating side of the apparatus.

The blocks 1 transported by the block conveyor means 2 to the apparatus, are initially provided with a very thin film of hot melt at both lateral edges of the block back surfaces by means of the glueing rollers 7, 8 that have been set at the angle required by the degree of fanning of block 1 by means of pivoting the glue pans 4, 5. The blocks 1 are led straight over the glueing roller 9 so that the block back surfaces are provided thereby with a relatively thick covering layer of glue. The height of the glue level in the glue pans 4 to 6 is checked by means of the sight glass 20, and glue is added through a funnel 21 when exceeding a lower limit.

It will be understood that each of the elements described above, or two or more together, may also find a useful application in other types of apparatus for application a hot melt glue onto the back surfaces of blocks differing from the types described above.

While the invention has been illustrated and described as embodied in an apparatus for application a hot melt glue onto the back surfaces of blocks, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. In an apparatus for application of hot melt glue to back surfaces of blocks, particularly for glueing book blocks, the combination comprising means for transporting blocks in a longitudinal direction adapted to support the blocks with their back surfaces oriented in a downward direction; a plurality of glue pans containing a glue to be applied to the blocks and positioned below said transporting means; and a plurality of rotary glueing rollers sequentially positioned in said longitudinal direction and each supported in the respective glue pan and adapted to contact the back surfaces of the blocks being transported, at least two of said glueing rollers having a conical outer surface and being set at an angle toward each other, said at least two glueing rollers together with the respective glue pans in which said rollers are supported being adapted to pivot with respect to the blocks transported in said longitudinal direction, at least one of said glueing rollers positioned after said two glueing rollers in said longitudinal direction having a cylindrical outer surface to provide for uniform application to the block back surfaces of glue, distributed in fan-like fashion.

2. The combination of claim 1, wherein each of said glue pans is arranged to be adjusted in a vertical direction.

3. The combination of claim 2, further comprising a return spinning roller mounted in the proximity with said one glueing roller and adapted to be driven in a direction opposite to the direction of rotation of said one roller.

4. The combination of claim 3, wherein said glue pans are interconnected with one another to provide the equalization of a level of hot melt glue in all of said glue pans.

5. The combination of claim 4, wherein said glue pans are interconnected by longitudinally and angularly adjustable heat-resistance pipes.

6. The combination of claim 5, further including seals each mounted between each end of the respective pipe and the respective glue pan, said seals being supported in said glue pans.

7. The combination of claim 6, wherein said seals are made of polytetrafluorethylene.

8. The combination of claim 7, further including a sight glass.

9. The combination of claim 8, wherein said sight glass is a component of one of said glue pans.

10. The combination of claim 9, further comprising guide means positioned above said two rollers in the region of said transporting means and adapted to aid the distribution of the back surfaces of the blocks being treated in fan-like fashion.

* * * * *